United States Patent [19]

Farley

[11] 4,281,715

[45] Aug. 4, 1981

[54] BYPASS VALVE

[75] Inventor: David L. Farley, Duncan, Okla.

[73] Assignee: Halliburton Company, Duncan, Okla.

[21] Appl. No.: 39,488

[22] Filed: May 16, 1979

[51] Int. Cl.[3] ..... E21B 47/00

[52] U.S. Cl. ..... 166/317; 137/70; 166/323

[58] Field of Search ..... 166/317, 318, 319, 321, 166/323, 325; 137/70, 71

[56] References Cited

U.S. PATENT DOCUMENTS

| | | | |
|---|---|---|---|
| 3,822,745 | 7/1974 | Mott | 166/323 |
| 3,970,147 | 7/1976 | Jessup et al. | 166/323 |
| 3,981,360 | 9/1976 | Marathe | 137/70 |
| 4,044,829 | 8/1977 | Jessup | 166/323 |
| 4,105,075 | 8/1978 | Helmus | 166/321 |

*Primary Examiner*—James A. Leppink

*Attorney, Agent, or Firm*—John H. Tregoning; James R. Duzan

[57] ABSTRACT

A bypass valve for use with an oil well testing string is disclosed which includes a spring loaded check valve which is normally in the closed position. If pressure in the interior of the test string is higher than the pressure in the well annulus, the check valve means opens until the interior pressure is equalized with the well annulus pressure. When the interior string pressure is reduced to that pressure present in the well annulus, the check valve means returns to the closed condition. The check valve means contains frangible shear means which shear when the well annulus pressure exceeds the interior string pressure by a predetermined amount. The check valve means then moves to the locked closed condition. The bypass valve disclosed is intended for use in a testing string for an oil well, and is to be placed in the testing string below a normally closed tester valve and above a seal assembly for insertion into sealing engagement with a preset production type packer. This bypass valve relieves elevated internal pressure in the testing string generated while the seal assembly is further lowered into the packer.

2 Claims, 7 Drawing Figures

BYPASS VALVE

BACKGROUND OF THE INVENTION

Figure 1:
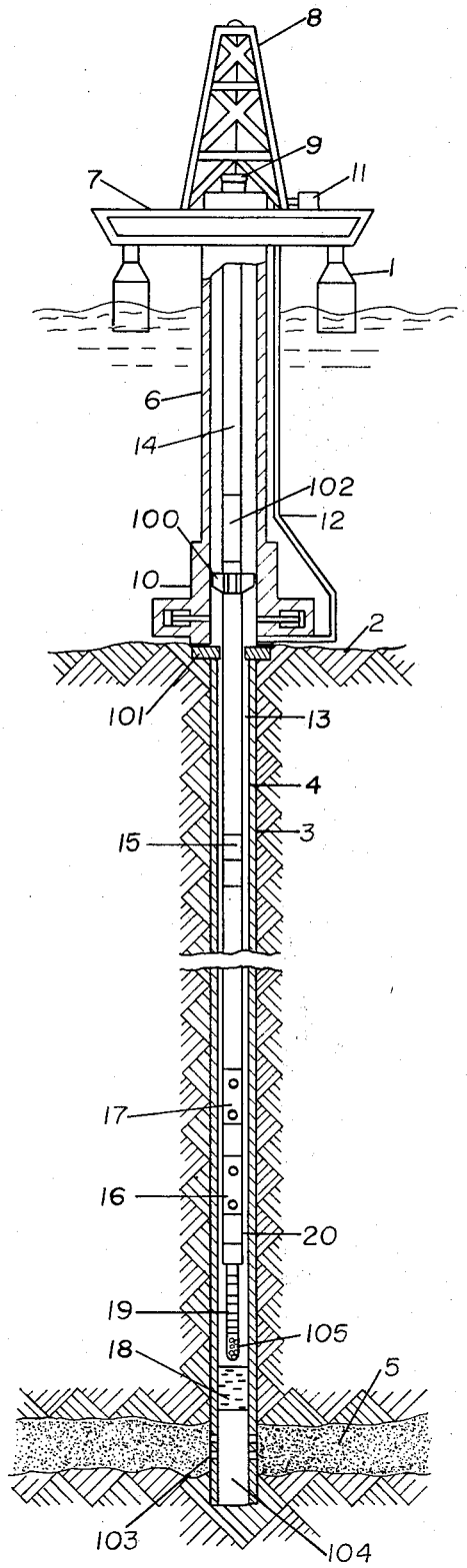

This invention relates to an apparatus for use with a tubing string used in conducting drill stem tests of oil and gas wells. More particularly, the apparatus relates to a check valve apparatus allowing trapped fluid to flow from the interior of the test string to the well annulus when the testing string is being lowered in a well bore into sealing engagement with a wireline set production type packer.

During the drilling of oil and gas wells, drilling fluid known as mud is used, among other things, to maintain formation fluids in intersected formations by virtue of its hydrostatic pressure. In order to allow the formation fluids to flow to the surface for analysis, it is necessary to isolate the formation to be tested from the hydrostatic pressure of the drilling fluid in the well annulus. This is done by lowering a tubular string to the formation to be tested, and then sealing the well annulus between the tubular string and above the formation with a packer.

Typically a tester valve is included at the lower end of the tubular string and is lowered in the closed condition such that a lower pressure exists in the center bore of the tubular string. After the formation is isolated from the well annulus, the tester valve is opened to lower the pressure in the well bore adjacent the formation to be tested such that formation fluids may flow from the formation into the lower end of the tubular string and from there to the surface.

Pressure sensors are typically included in the test string such that the tester valve may be opened and closed and pressure recordings made to evaluate the production potential of the formation being tested.

Two types of packers may be used. The first type is a packer which may be incorporated in a tubular string and expanding by manipulation of the tubing string to effect the seal between the walls of the well bore and the tubular testing string. A second type is a wireline set production packer which is lowered and attached to the walls of the well bore at the desired location. The tubular string having a seal assembly at its lower end, is then lowered into the well bore until the seal assembly is seated in the production type packer to effect the seal necessary to isolate the formation.

It will be understood that if a production type packer is used, fluid trapped in the well bore below the production packer will be compressed as the tubular string is further lowered into place after the seal assembly has effected its seal in the production packer. This trapped fluid in the well bore below the packer must be displaced back into the formation as the seal assembly is further lowered into the packer. The displacement of drilling fluid into the formation is undesirable in that it may seal the port spaces in the formation through which oil and gas must be produced. Also, if an annulus pressure operated well tester valve having a pressure operated isolation valve such as that disclosed in U.S. Pat. No. 3,964,544 or U.S. Pat. No. 3,976,136 is used, the compression of fluid in the central bore of the well string below the tester valve will increase the operating pressure of the tester valve to an undesirably high level.

The use of the disclosed embodiments prevents high pressure from the trapped fluid from developing which might otherwise damage the packer, the pressure recorder, the tester valve, or other tools in the testing string. Also, this trapped fluid might support the testing string and prevent its downward movement to completely seat in a hanger. When a test valve in the testing string is subsequently opened, the trapped fluid will be released allowing the testing string to fall which may in turn damage the tubing of the string, the hanger or the packer.

In the disclosed embodiments of the present invention, a check valve means is provided below the tester valve and above the seal assembly at the lower end of the testing string, and is designed to allow compressed fluid in the central bore of the testing string below the closed tester valve to escape to the well annulus above the packer. When the well annulus pressure is increased to operate tester valves such as those disclosed in the aforementioned U.S. Pat. Nos. 3,964,544 and 3,976,136, the check valve prevents pressure from increasing in the testing string central bore, and a blocking mechanism is activated to block the check valve means in a closed position. The blocking means is then locked in the closed position such that treating operations of the formation, as disclosed in U.S. Pat. No. 3,976,136, may be conducted wherein specialized chemicals, such as an acid, may be displaced into the formation without escaping into the well annulus through the check valve.

The invention disclosed makes the use of annulus pressure operated testing apparatus in combination with a production type packer more efficient in that the pressure level necessary to operate the testing tools is not unduly raised, and the operation of the tools is not otherwise affected.

THE DRAWINGS

A brief description of the appended drawings follows:

FIG. 1 provides a schematic "vertically sectioned" view of a representative offshore installation which may be employed for formation testing purposes and illustrates a formation testing "string" or tool assembly as it is being lowered into a submerged well bore to the point just before the seal assembly enters a production type packer, and with the testing string extending upwardly to a floating operating and testing station.

Figure 2:
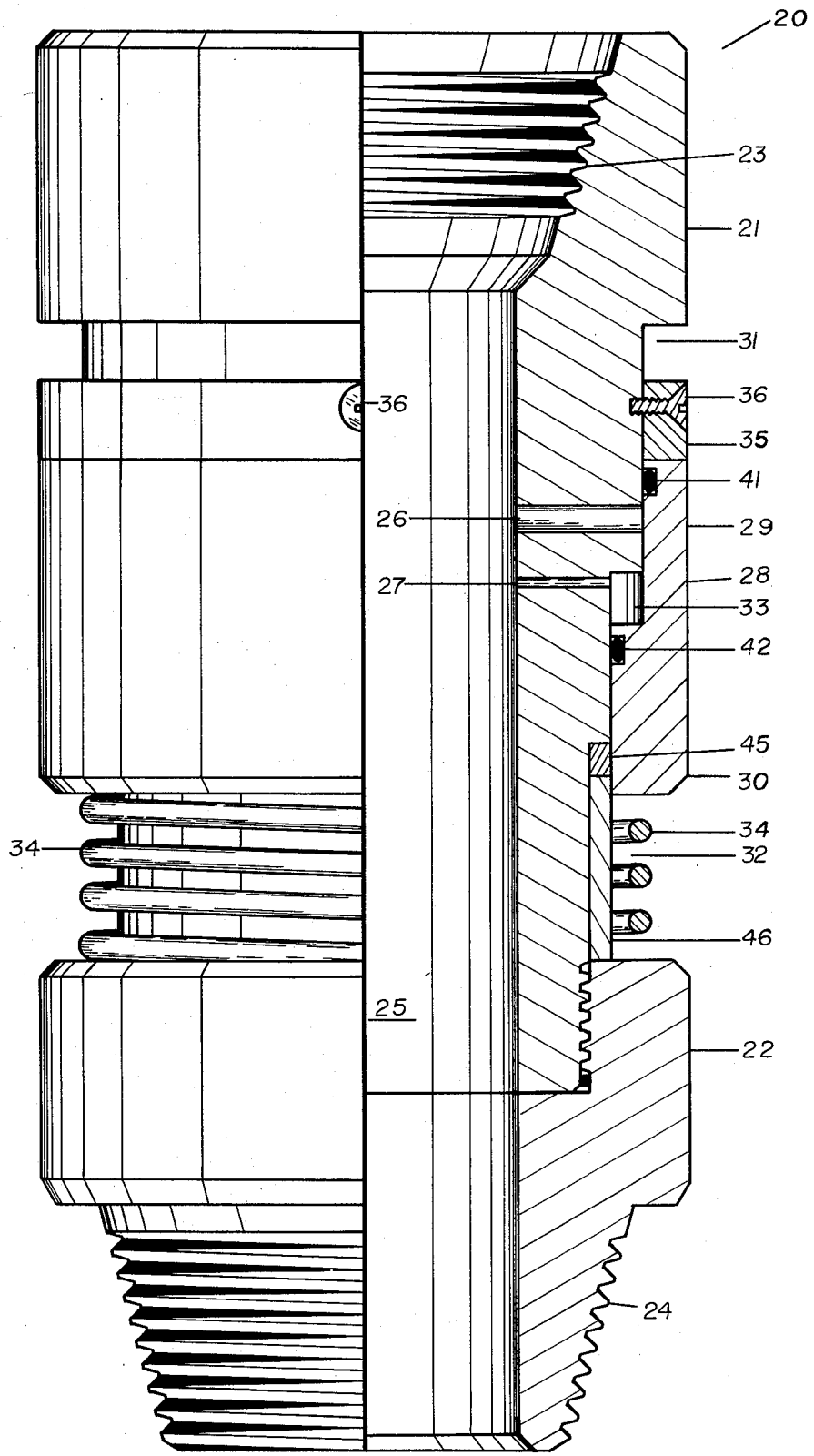

FIG. 2 provides a "vertically sectioned" elevational view of a preferred embodiment of the invention showing a check valve means, a shear means for setting the operating pressure of the assembly, and a locking means.

FIGS. 3*a*–3*d* joined along section lines *a*—*a*, *b*—*b*, and *c*—*c* provide a "vertically sectioned" elevation view of a preferred embodiment of the invention showing a check valve means having a radially extensible rubber sleeve, a closing means for closing the check valve means when well annulus pressure is increased, a delay means for delaying the closing of the check valve means, and a locking means for locking the closing means in the closed position.

Figure 4:
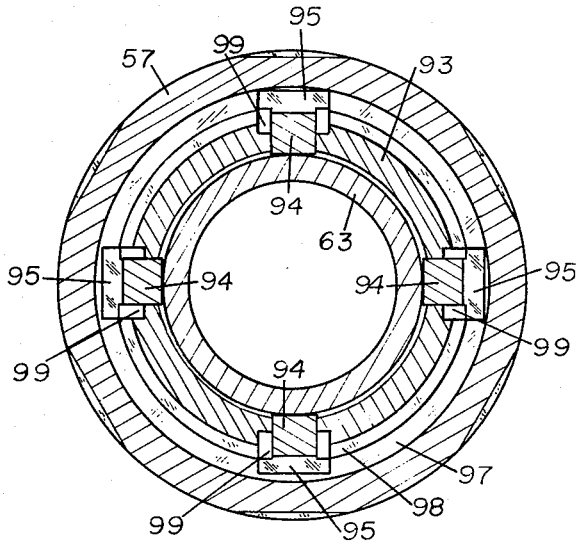
Figure 3A:
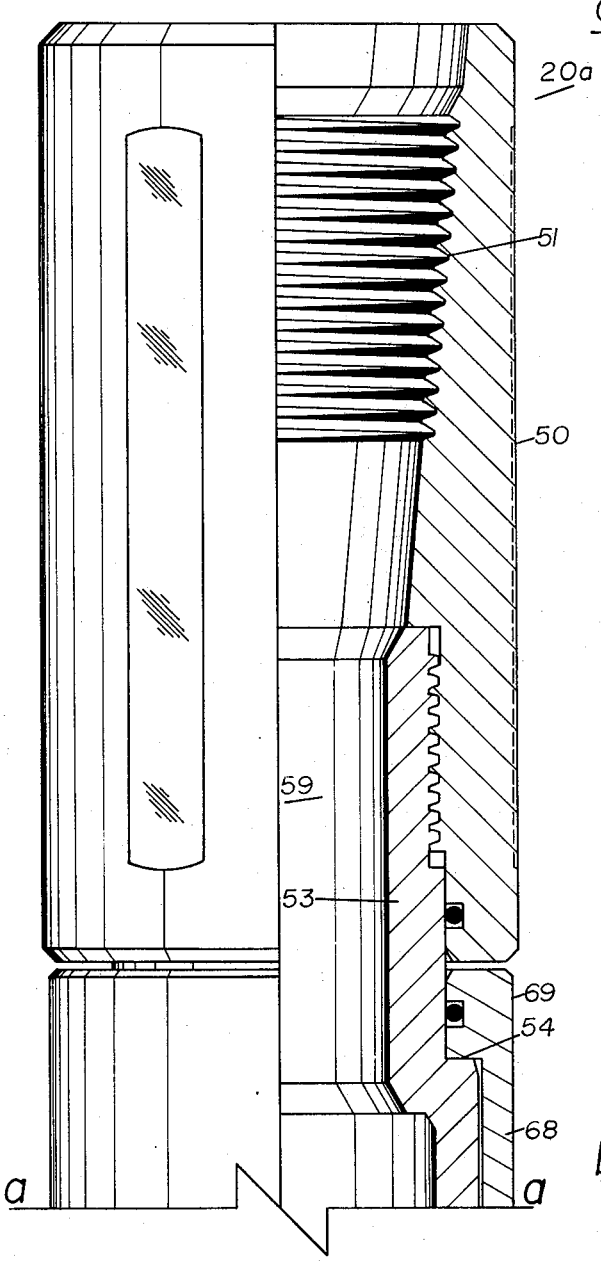
Figure 3B:
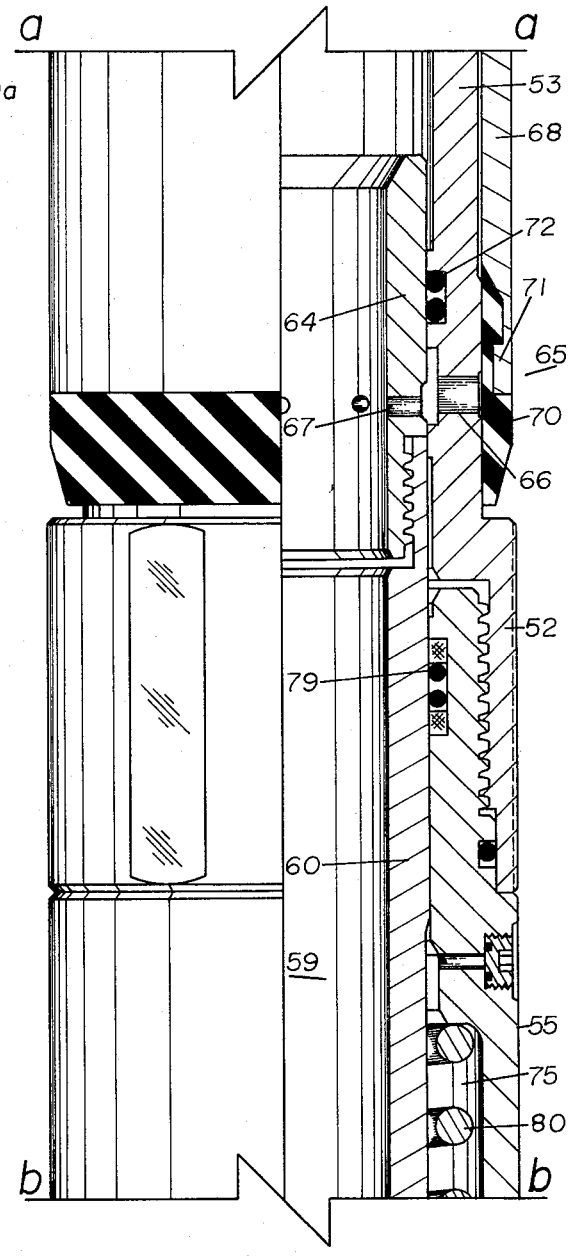
Figure 3C:
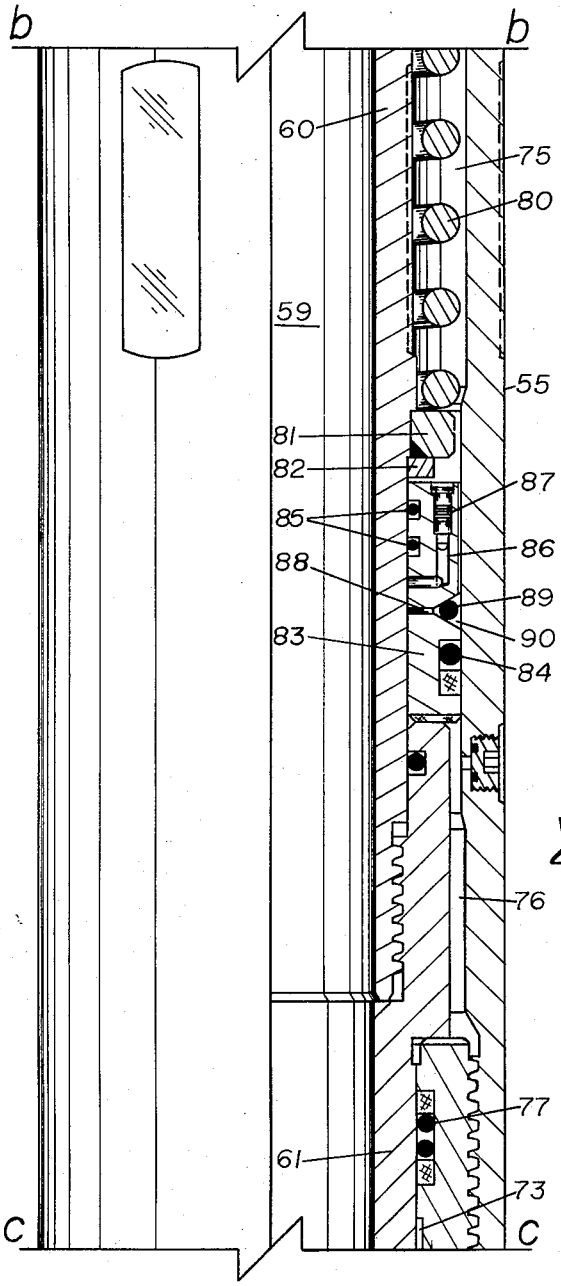
Figure 3D:
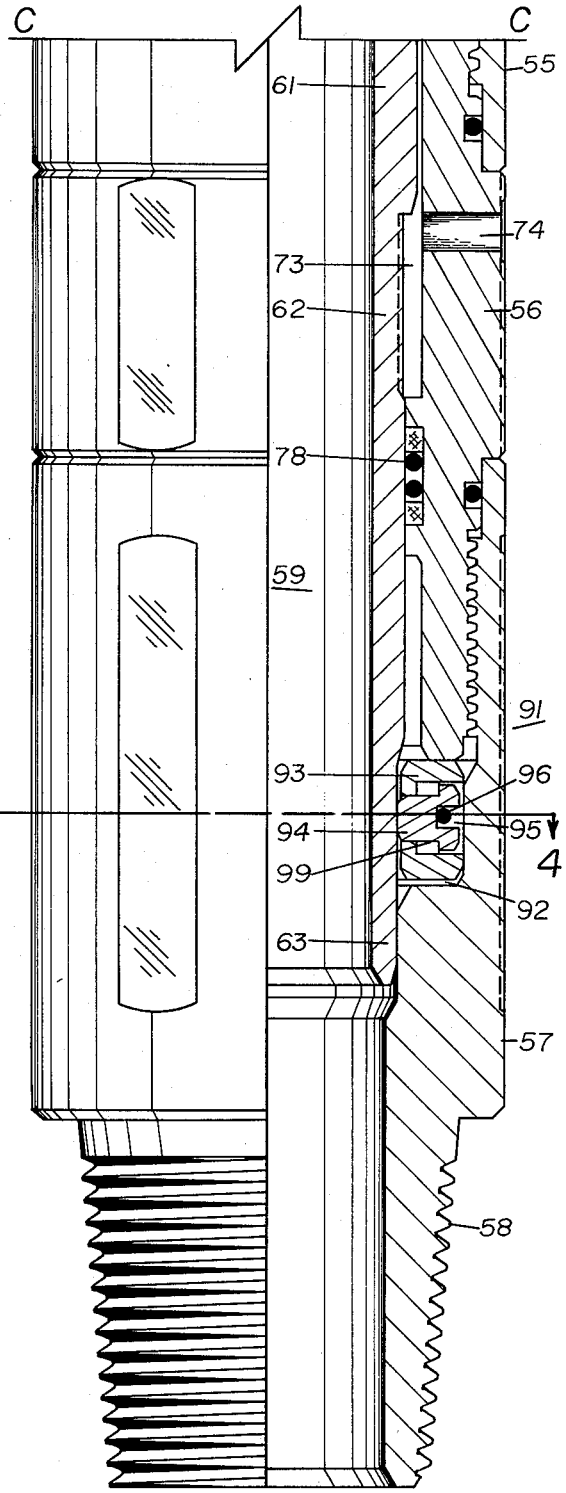

FIG. 4 is a cross-sectional view of the apparatus of FIGS. 3*a*–3*d* taken along section line 4—4 of FIG. 3*d* showing details of the locking means.

ENVIRONMENT

The apparatus of the present invention may be used with a testing string for offshore oil wells as illustrated in FIG. 1.

In FIG. 1 is shown a floating work station 1 centered over a submerged oil well located on the sea floor 2 and having a borehole 3 which extends from the seal floor 2 to a submerged formation 5 to be tested. The borehole 3 is typically lined by a steel liner 4 cemented into place. A subsea conduit 6 extends from the deck 7 of the floating work station 1 to a well head installation 10. The floating work station 1 has a derrick 8 and a hoisting apparatus 9 for raising and lowering tools to drill, test and complete the oil well.

Illustrated in FIG. 1, a testing string 14 is being lowered into place in the borehole 3 of the oil well. The testing string 14 includes such tools as a slip joint 15 to compensate for the wave action of the floating work station 1 as the testing string is being lowered into place, a tester valve 16 and a circulation valve 17.

The slip joint 15 may be similar to that described in U.S. Pat. No. 3,354,950 issued to Hyde on Nov. 28, 1967. The tester valve 16 may be one of the annulus pressure responsive type and is preferably one of the full opening types such as described in U.S. Pat. No. 3,856,085 issued to Holden et al Dec. 24, 1974, or that described in U.S. Pat. No. 3,976,136 issued to Farley et al Aug. 24, 1976, or that described in U.S. Pat. No. 3,964,544 issued to Farley et al June 22, 1976.

The circulation valve 17 is preferably of the annulus pressure responsive type and may be that described in U.S. Pat. No. 3,850,250 to Holden et al issued Nov. 26, 1974, or may be a combination circulation valve and sample entrapping mechanism similar to those disclosed in U.S. Pat. No. 4,063,593 issued to Jessup Dec. 20, 1977 or U.S. Pat. No. 4,064,937 issued to Barrington Dec. 27, 1977. The circulation valve 17 may also be the reclosable type as disclosed in U.S. Pat. No. 4,113,012 issued to Evans et al Sept. 12, 1978.

As described in the aforementioned U.S. Patents, both the tester valve 16 and the circulation valve 17 are operated by annulus pressure exerted by a pump 11 on the deck of the floating work station 1. Pressure changes are transmitted by a conductor pipe 12 to the well annulus 13 between the casing 4 and the testing string 14. Well annulus pressure is isolated from the formation 5 to be tested by a packer 18 set in the well casing just above the formation 5. The check valve assembly 20 of the present invention is located in the testing string 14 below the tester valve 16. This check valve assembly 20 is most advantageously used with a permanent production type packer 18 which, for instance, may be the Baker model D packer, the Otis type W packer or the Halliburton EZ DRILL ® SV packer. Such packers are well known in the oil well testing art.

The testing string 14 includes a tubing seal assembly 19 at the lower end of the testing string 14 which stabs through a passageway through the production packer 18 for forming a seal isolating the well annulus 13 above the packer 18 from an interior bore portion 104 of the well immediately adjacent the formation 5 and below the packer 18.

A perforated tail piece 105 or other production tube is located at the bottom end of the seal assembly 19 to allow formation fluids to flow from the formation 5 into the flow passage of the testing string 14. Formation fluid is admitted into well bore portion 104 through perforations 103 provided in the casing 4 adjacent formation 5.

A formation test controlling the flow of fluid from the formation 5 through the flow channel in the testing string 14 by applying and releasing annulus pressure to the well annulus 13 by the pump 11 to operate the tester valve 16 and the circulation valve assembly 17 and measuring the pressure build-up curves with appropriate pressure sensors in the testing string 14 as fully described in the aforementioned patents.

The testing string 14 is lowered into the oil well bore 3 by the hoisting means 9 until a fluted hanger 100 is in supporting contact with a supporting pad means 101 at the sea floor 2. Above the fluted hanger 100 is a subsea test tree 102 which may be, for instance, the pressure operated subsea test tree disclosed in U.S. Pat. No. 4,116,272 issued to Barrington Sept. 26, 1978, or may be the hydraulically operated subsea test tree available from Otis Engineering Corporation of Dallas, Texas.

One common way of locating the fluted hanger 100 at the proper location in the testing string 14, is to lower the testing string 14 without the hanger into the oil well bore 3 until the seal assembly 19 is fully inserted into the packer 18 and the bottom end of the testing string 14 rests on top of the packer 18. This event is indicated at the surface by a reduction in the weight of the testing string 14 as more and more of the weight is supported by the packer 18. The testing string 14 is then marked, and the testing string 14 is removed sufficiently such that the fluted hanger 100 may be installed in the testing string 14 at the proper distance below the mark such that when the testing string 14 is re-lowered into the oil well bore 3, the fluted hanger 100 rests on the pad means 101 and the sealing means 19 will be inserted into the packer 18 but without the weight of the testing string 14 being supported by the packer 18.

It can be seen that when the sealing means 19 is inserted into the packer 18, fluid will be trapped in central bore portion 104. This trapped fluid must be displaced back into the formation as the sealing means 19 is inserted further into the interior bore 104. It will also be understood that movement of the sealing means 19 and the perforated tail piece 105 into the interior bore 104 will cause the pressure in the interior bore portion 104 to rise, thus increasing the pressure necessary to operate a pressure operated isolation valve used in tester 16, if a tester valve such as that disclosed in U.S. Pat. No. 3,964,544 is used.

The check valve assembly 20 of the present invention is installed below the tester valve 16 for allowing trapped formation fluid in interior bore portion 104 to move into the well annulus 13 as the sealing assembly 19 is pushed further and further into interior bore portion 104. This prevents the excessive build-up of pressure in the interior of the testing string 14 below the tester valve 16 and also prevents drilling mud in interior bore portion 104 from being pushed into the formation 5 as the testing string 14 is lowered during its last increment of travel into place.

PREFERRED EMBODIMENTS

One of the preferred embodiments is shown as check valve assembly 20 in FIG. 2. The check valve assembly 20 has an upper outer casing 21, a lower outer casing 22, and an interior bore 25 for communication with the flow passage through the testing string.

Threads 23 are provided in upper outer casing 21 to join the assembly 20 to the testing string for instance under the tester valve as discussed in connection with FIG. 1 and shown in U.S. Pat. No. 3,976,136 issued Aug. 24, 1976 to Farley et al or the tester valve shown in U.S. Pat. No. 3,964,544 issued June 22, 1976 to Farley et al. Threads 24 are provided in the lower outer casing 22 for use in installing the assembly 20 into the testing string as discussed in connection with FIG. 1.

A flow passage 26 and a pressure passage 27 are provided through the upper outer casing 21. Communication through the flow passage 26 is controlled by a check valve which has a sliding valve mandrel 28 which includes an upper sleeve portion 29 and a lower collar portion 30. The upper sleeve portion 29 covers flow passage 26 when the sliding valve mandrel 28 is in its normal uppermost position.

A cutout portion 31 is provided in upper outer casing 21 to receive the upper sleeve portion 29, and a lower cutout portion 32 is provided to receive the collar portion 30 of sliding valve mandrel 28. The shoulder between cutout portion 31 and cutout portion 32 provides a chamber 33 between casing 21 and the sleeve portion 29 and collar portion 30 of sliding valve mandrel 28. This chamber portion 33 communicates with the pressure passage 27 thereby communicating with the interior bore 25 of the assembly 20.

A spring means 34 is provided in cutout portion 32 and resiliently urges sliding valve mandrel 28 in the upward direction. A stop collar 35 is frangibly held in place by shear screws 36 to stop the upward movement of valve mandrel 28 until a predetermined force, as set by the shear screws 36, is exceeded in the upward direction. Sealing means, such as O-rings 41 and 42, are provided between the sliding valve mandrel 28 and the outer casing 21 as shown in FIG. 2 such that when the valve mandrel 28 is in its normal position, the flow passage 26 and pressure passage 27 are closed to prevent communication between the interior bore 25 and the well annulus surrounding the valve assembly 20.

It can be seen that if the pressure in the interior bore 25 exceeds the pressure in the well annulus, that this interior pressure will be communicated by passage 27 to the chamber means 33 to supply a downward force to the sliding valve mandrel 28. When the pressure differential is sufficient to overcome the force supplied by spring 34, the sliding valve mandrel 28 will move downwardly until flow passage 26 is opened allowing fluid to flow from the interior bore 25 to the well annulus surrounding the valve assembly 20. This flow will lower the interior pressure in bore 25 a sufficient amount such that spring 34 may again slide the sliding valve mandrel 28 upwardly until the sleeve portion 29 again covers flow passage 26 and the interior bore 25 is sealed from communication with the well annulus surrounding the valve assembly 20 by O-ring seals 41 and 42.

When the well annulus pressure is raised to operate the other well annulus pressure responsive tools in the testing string as described in connection with FIG. 1, an upwardly directed force will be generated due to the higher pressure in the well annulus as compared with the pressure in the central bore 25 of the valve assembly 20. When this upwardly directed force is sufficient to shear the shear screws 36 in the shear collar 35, the sliding valve mandrel 28 will move upwardly to its uppermost locked position.

A snap ring 45 is provided trapped between the collar portion 30 of the sliding valve mandrel 28 and the outer case 21 of the valve assembly 20 and sleeve 46. Snap ring 45 locks the valve mandrel in the uppermost position to lock flow passage 26 closed when collar portion 30 of valve mandrel 28 moves upwardly sufficiently to uncover the snap ring 45. Thus, if the interior pressure 25 is increased over the annulus pressure, such as in an acidizing or well treating application as described in connection with the tester valve disclosed in U.S. Pat. No. 3,964,544, the sliding valve mandrel 28 will not be moved to the opened position.

The sleeve 46 is sized to allow the collar portion 30 of the sliding valve mandrel 28 to move freely upwardly and downwardly as previously described. If desired, the sleeve 46 could be fabricated as a part of the upper outer casing 21.

In operation, the assembly 20 is incorporated into a testing string with a tester valve 16, such as that disclosed in the aforementioned U.S. Pat. No. 3,964,544, the entire specification of which is incorporated herein by reference, to open and close the flow passage through the testing string 14 from the formation 5 to the work station 1.

A further flow passage 26 is provided through the housing 21 of the tool 20 from the longitudinal passage through the testing string, which includes the bore 25 through the tool 20, to the annulus 13 of the well. This further flow passage 26 is blocked by the upper portion 29 of the sliding valve mandrel 28. This valve mandrel 28 is part of a check valve arrangement which is operated by a differential pressure between the inner bore 25 and well annulus 13. When the pressure in the bore 25 is higher than the pressure in the well annulus 13 by an amount sufficient to overcome the spring 34, the valve mandrel 28 moves to the open position.

When the well annulus pressure is equal to the pressure in the bore 25, the valve mandrel 28 moves to the closed position. When the well annulus pressure is increased to operate the tester valve 16 and is higher than the pressure in bore 25 by an amount sufficient to shear the shear screws 36, the valve mandrel 28 moves to a locked closed position.

A second preferred embodiment of the invention is shown as apparatus **20*a* in FIGS. 3*a* through 3*d*. The apparatus 20*a* includes an outer housing assembly having an upper housing member 50 having interior threads 51 for attaching the apparatus 20*a* into a testing string above the apparatus, a check valve housing member 52 having an upper extension 53 which includes a shoulder portion 54 to be explained later, a metering chamber housing 55, an intermediate housing 56, and a lower housing 57 having a lower threaded extension 58 for attaching the apparatus 20*a* into a testing string below the apparatus. The tubular housing assembly has an interior bore 59 passing through the entire apparatus 20*a***.

Within the tubular housing assembly is an inner sliding mandrel assembly having an inner sliding mandrel 60, an upper extension 64 threadably attached to the upper end of the sliding mandrel 60, and a piston mandrel 61 including a reduced portion 62 and a lower end 63.

The apparatus **20*a* includes a check valve means 65 having a plurality of check valve ports 66 through the check valve housing member 52 and communicating with a plurality of lateral ports 67 through the upper extension 64 of the inner sliding mandrel assembly. A check valve 68 is positioned over the upper extension 53 of the check valve housing 52 and has a collar 69 which is trapped between the shoulder 54 of extension 53 and the lower end of the upper housing member 50 as shown in FIG. 3*a*. This arrangement securely holds in place the check valve sleeve 68**.

A rubber skirt 70 is positioned over the check valve ports 66 as shown in FIG. **3*b* and held in place by lip 71 on the lower end of check valve sleeve 68. This rubber skirt 70 is provided to allow fluid passage from the inner bore 59 to move through communicating ports 67 and 66 into the area exterior of the assembly 20***a*, while preventing fluid flow from the well annulus exterior of assembly 20*a* into the interior bore 59 through the mentioned ports 66 and 67.

A sealing means 72 is provided between the extension 53 of check valve housing member 52 and the upper extension 64 of the inner sliding mandrel assembly and is designed to provide a seal between the housing extension 53 and the inner sliding mandrel member 60 when the inner sliding mandrel assembly moves upwardly to its closed position.

A power chamber 73 shown in FIG. 3*d* is provided between the intermediate housing member 56 and the power piston mandrel 61 of the inner sliding mandrel assembly. A power port 74 through the intermediate housing member 56 provides communication from the well annulus exterior of the assembly 20*a* with the power chamber 73.

An oil filled chamber shown in FIG. 3*c* is provided between the metering chamber housing member 55 and the inner sliding mandrel member 60 and is divided into an upper portion 75 and a lower portion 76. The lower end of the lower oil filled chamber portion 76 is sealed by sealing means 77. Sealing means 78 shown in FIG. 3*d* is provided in the lower end of power chamber 73 and has a smaller radius than the radius of sealing means 77 to provide an annular piston in piston mandrel 61 such that well annulus pressure which is higher than the pressure in the interior bore 59 of the apparatus 20*a* will urge the piston mandrel 61 and the connected inner sliding mandrel assembly upwardly.

An upper sealing means 79 shown in FIG. 3*b* is provided between the sliding mandrel member 60 and the metering chamber housing 55 to seal the upper end of the oil filled chamber portion 75.

A mechanical spring 80 is provided in the oil filled chamber portion 71 to urge the inner sliding mandrel downwardly to a normally open position allowing fluid communication to flow through communicating ports 67 and 66. A pillow ring 81 is provided in sliding mandrel member 60 to compress the spring 80 when the inner sliding mandrel assembly moves upwardly. A retaining ring 82 holds pillow ring 81 in position. A metering piston means 83 is trapped between the retaining ring 82 and the upper end of power piston mandrel 61 and includes sealing means 84 and 85 to separate the upper oil filled chamber 75 from the lower oil filled chamber 76.

A metering passage 86 is provided through the metering piston means 83 as shown in FIG. 3*c*. The metering passage 86 includes a metering means 87 such as a Lee Visco jet available from the Lee Company of Westbrook, Connecticut. This metering means is provided for controlling the rate of oil passage from the upper chamber 75 to the lower chamber 76 to control the movement of the inner sliding mandrel assembly in the upward direction. A bypass means including a bypass passage 88, an O-ring 89, and a V-groove 90 in the metering piston means 83 is provided to provide a means of bypassing oil around the metering means 87 when the inner sliding mandrel assembly is moving in the downwardly direction.

A locking means 91 shown in FIG. 3*d* is provided in the lower end of assembly 20*a* and includes a locking means cavity 92 between the lower housing member 57 and the lower end 63 of the power piston mandrel 61. Located in the cavity 92 is a ring member 93 having a plurality of plugs 94 spaced in stepped holes 99 around its periphery. Each locking plug 94 includes a groove 95. An O-ring 96 is stretched around the locking plugs in the ring member 95 for providing an inwardly directed force against each plug.

The operation of the locking means can better be understood by referring to FIG. 4 which is a transverse section of the apparatus 20*a* taken along section line 4—4 of FIG. 3*d*. The O-ring 96 has been omitted from FIG. 4 for the sake of clarity.

The ring member 93 has a groove 97 aligned with the groove 95 in the locking plugs 94 for receiving the O-ring 96. A more inwardly groove 98 is provided in ring member 93 for allowing the O-ring 96 to move radially inwardly to move the locking plugs 94 to the bottom of the stepped holes 99 when end 63 moves to its uppermost position.

It will be understood when the inner sliding mandrel assembly moves upwardly to block port 66, lower end 63 of the inner mandrel assembly will move upwardly until it clears the locking plugs 94 allowing the locking plugs to move inwardly to their seated position. When locking plugs 94 have moved inwardly, the inner sliding mandrel assembly may not move downwardly past the locking plugs 94 which will now extend into the interior bore 59 of the apparatus 20*a*.

It will be understood that when the apparatus 20*a* is substituted for the apparatus 20 in FIG. 1, and the tool is being lowered into the well bore 3, the pressure in the well annulus 13 will be equal to the pressure in the interior bore 59 of the apparatus 20*a*. Thus, while the tool is being lowered into place there will be no transfer of fluid through the communicating passages 66 and 67. When the testing string 14 is lowered sufficiently such that the seal assembly 19 is sealingly inserted into packer 18, the pressure in the interior bore 59 will begin to raise higher than the pressure in the well annulus 13 as the testing string is lowered further into the hole and well fluid trapped in the well bore portion 104 is compressed by the seal assembly 19 moving into portion 104. This higher pressure in the interior bore 59 will cause rubber skirt 70 to move radially outwardly to allow fluid to flow through ports 67 and 66 and into the well annulus 13. When enough fluid moves out of interior bore 59, the pressure in the interior bore 59 will again equal the well annulus pressure, and the rubber skirt 70 will move back to its closed position.

In this manner, well fluid will be removed from well bore portion 104 until the testing string is fully seated into place. When the testing string has been lowered sufficiently, a portion of the testing string weight is supported by the packer 18 and will be registered at the surface by a change in the "weight on hook" indication. The testing string will be marked at the surface 7 of the work station 1 and the testing string 14 will be removed from the well bore a sufficient distance such that the fluted hanger 100 may be installed at the proper location in the testing string. The testing string 14 is then once again lowered into the well bore 4 until the fluted hanger 100 comes to rest on the supporting pad means 101. The fluted hanger 100 is installed in the testing string 14 such that the weight of the testing string 14 below the hanger 100 will be supported by the hanger 100 with the sealing assembly 19 inserted into the packer 18.

It can be understood that when the testing string 14 is withdrawn from the well bore 4 to install the fluted hanger 100, the volume of the sealing assembly 19 and the perforated tail piece 105 will be removed from the well bore portion 104 of the well, and if well fluid is not replaced into the portion 104 the pressure in the interior bore 59 of the apparatus will be lower than the pressure in the well annulus 13. In the embodiment discussed in connection with FIG. 2, this lower pressure would cause the shear pins 36 to shear and the sleeve portion 29 to move upwardly and lock into place blocking flow passage 26. Thus the apparatus discussed in connection with FIG. 2 could not again be used to insert the sealing assembly 19 into the packer 18 after the fluted hanger 100 had been installed in the test string 14. In the apparatus 20*a* discussed in connection with FIGS. 3*a* through 3*d*, the metering means 87 in the metering piston 83 would control the movement of the inner sliding mandrel assembly in the upward direction when the interior bore pressure was lowered as described in connection with the installing of the fluted hanger 100. This delayed movement of the inner sliding mandrel assembly would be sufficient to allow the formation 5 to produce fluid to fill well bore portion 104 and allow removal of the sealing means 19 from the packer 18. The fluted hanger 100 could then be installed in the testing string 14 and the testing string 14 relowered into the well bore 4 until the fluted hanger 100 was supported by the pad means 101 as previously described.

The annulus pressure operated tester valve 16 may then be operated in the usual manner. When the well annular pressure is raised to operate the tester valve 16, the inner sliding mandrel assembly would move upwardly at the metered rate until the sliding mandrel member 60 blocked the ports 66, and the lower end 63 passed the locking plugs 94. The locking plugs 94 would then move inwardly to lock the check valve means 65 in the closed condition for the remainder of the testing program. This locked closed condition would be further advantageous as well treating operations could be conducted by pumping various well treating fluids through the testing string and into the formation 5 thereby raising the pressure in the interior bore 59 with the check valve assembly 65 in the locked closed position. This treating operation is further described in connection with the tester valve 16 in U.S. Pat. No. 3,964,544.

The embodiment of FIGS. 3*a*–3*d* may be used with a long sealing assembly 105 to eliminate the necessity of slip joint 15. The action of the check valve means 65 and the metering means 87 would allow the sealing assembly 105 to move up and down in the packer 18 with the wave motion of the floating work station 1 while the testing string was being lowered into place without closing the check valve means 65.

To review the operation of the embodiment of FIGS. 3*a*–3*d*, the assembly 2*a* is incorporated into a testing string 14 such that the interior bore 59 of the apparatus forms part of the flow passage through the testing string from the formation 5 to the work station 1. This flow passage is controlled by the annulus pressure responsive tester valve 16 in the testing string.

A further flow passage through the tubing walls 52 of the apparatus 20*a* is provided by ports 66 interconnected with ports 67 through upper extension 64. This further flow passage is controlled by a differential pressure valve means comprising the radially extensible rubber skirt 70 located around the outer periphery of the apparatus over the ports 66 such that when the pressure in the central bore 59 is greater, the rubber skirt is moved away from the ports 66 to allow fluid flow from the bore 59 into the well annulus 13. When the well annulus pressure is higher than the bore pressure, the rubber skirt is sealed against the ports 66 such that fluid cannot flow from the well annulus 13 into the central bore 59.

When the well annulus pressure is held at an elevated value for a sufficient length of time, the inner sliding mandrel assembly moves upwardly to seal the inward ends of the ports 66 in a locked closed position.

The scope of the protection afforded by the patent is to be measured by the appended claims, which claims are intended to cover the disclosed embodiments of the invention and all equivalent embodiments which fall into the spirit and the scope of the claims as may be envisioned by those skilled in the art.

What is claimed is:

1. An apparatus for use in a well testing string extending from the surface to a formation to be tested, said apparatus comprising:

a tubular housing having an interior bore therethrough and a port through the walls thereof;

a sliding sleeve member disposed in a first normally closed position for blocking said port and operable to a second open position for opening said port for allowing fluid to flow from the interior bore to the exterior of said apparatus, said sliding sleeve member having a differential piston exposed on one side to the pressure in the interior bore and on the other side to pressure exterior of the apparatus for moving said sliding sleeve member to the second open position when the interior bore pressure exceeds the exterior pressure and for moving said sliding sleeve member to the first normally closed position when the exterior pressure is higher than the interior pressure;

spring means for urging said sliding sleeve member to the first normally closed position;

a frangible stop means impinged upon by said sliding sleeve member in the first normally closed position arranged for stopping said sliding sleeve member between a first normally closed position and a third locked closed position and for allowing said sliding sleeve member to move to the second open position; and a locking means for locking said sliding sleeve member in the third locked closed position after said sliding sleeve member shears said frangible stop means and moves to said third locked closed position.

2. Well test apparatus having, in a well, an annulus therearound comprising:

a housing having a longitudinally extending fluid passage;

annulus pressure operated valve opening and closing means for fluid passing through the longitudinally extending passage;

a further fluid passage to permit fluid flow through the housing from the longitudinally extending passage to the annulus;

a slidable piston having one side exposed to the pressure of the longitudinally extending passage and the other side exposed to the annulus pressure, the piston further having a portion cooperating with the further passage so as to open and close fluid flow therethrough depending on the position thereof;

the slidable piston being urged to the open position thereof responsive to pressure in the longitudinally extending passage and being urged to the closed position responsive to annulus pressure;

spring means for urging the slidable piston to the closed position;

frangible stop means impinged upon by the slidable piston in the closed position arranged for stopping the slidable piston between the closed position and a locked closed position and for allowing the slidable piston to move to the open position from the closed position; and locking means for locking the slidable piston in the locked closed position after the slidable piston member shears the frangible stop means and moves to the locked closed position.

* * * * *

UNITED STATES PATENT AND TRADEMARK OFFICE

CERTIFICATE OF CORRECTION

PATENT NO. : 4,281,715

DATED : August 4, 1981

INVENTOR(S) : David L. Farley

It is certified that error appears in the above-identified patent and that said Letters Patent are hereby corrected as shown below:

In column 2, line 3, delete the word "test" and substitute therefore --tester--.

In column 2, line 51, delete the word "elevation" and substitute therefore --elevational--.

In column 3, line 1, delete the word "seal" and substitute therefore --sea--.

In column 8, line 13, delete the word "inwardly" and substitute therefore --inward--.

In column 9, line 29, delete the word "annular" and substitute therefore --annulus--.

Signed and Sealed this

*Third* Day of *November 1981*

[SEAL]

*Attest:*

GERALD J. MOSSINGHOFF

*Attesting Officer*

*Commissioner of Patents and Trademarks*